US006299006B1

(12) United States Patent
Samonek

(10) Patent No.: US 6,299,006 B1
(45) Date of Patent: Oct. 9, 2001

(54) WHISTLING BEVERAGE BOTTLE CONSTRUCTION

(76) Inventor: Michael E. Samonek, 2318 S. Overlook Rd., Cleveland Heights, OH (US) 44106

( * ) Notice: Subject to any disclaimer, the term of this patent is extended or adjusted under 35 U.S.C. 154(b) by 0 days.

(21) Appl. No.: 09/458,386

(22) Filed: Dec. 10, 1999

(51) Int. Cl.[7] ..... B65D 51/16

(52) U.S. Cl. ..... 215/307; 215/45; 215/308; 215/310; 116/70; 116/112; 116/137 R

(58) Field of Search ..... 215/307, 43–45, 215/261, 262, 308, 309, 310, 311; 220/366.1; 116/70, 112, 264, 266, 268, 137 R

(56) References Cited

U.S. PATENT DOCUMENTS

| | | | | |
|---|---|---|---|---|
| 2,424,801 | * | 7/1947 | Crabbe et al. | 215/307 |
| 3,043,463 | * | 7/1962 | Beall, Jr. | 215/307 |
| 3,181,720 | * | 5/1965 | Cassie et al. | 215/307 |
| 4,121,375 | * | 10/1978 | Erickson et al. . | |
| 4,392,579 | * | 7/1983 | Uhlig et al. | 215/307 |
| 4,398,491 | * | 8/1983 | Fridl et al. | 215/262 |
| 4,583,651 | | 4/1986 | Ostberg . | |
| 4,607,747 | | 8/1986 | Steiner . | |
| 4,756,222 | | 7/1988 | Armato . | |
| 4,997,097 | * | 3/1991 | Krautkramer | 215/307 |
| 5,207,339 | | 5/1993 | Shyu . | |
| 5,328,069 | | 7/1994 | Cohanfard . | |
| 5,785,196 | * | 7/1998 | Montgomery | 215/307 |

FOREIGN PATENT DOCUMENTS

| | | | |
|---|---|---|---|
| 288862 | * | 11/1988 | (EP) . |
| 8001976 | * | 11/1981 | (NL) . |

* cited by examiner

*Primary Examiner*—Nathan J. Newhouse
(74) *Attorney, Agent, or Firm*—Henderson & Sturm LLP

(57) ABSTRACT

A whistling beverage bottle construction (10) including: a cap member (20) adapted to engage the threaded neck portion (31) of a bottle member (30) having a peripheral lip (33) which surrounds the mouth opening (32) of the bottle member (30). The peripheral lip (33) is provided with a notch (34) and a resilient sealing gasket member (40) disposed intermediate the cap member (20) and the peripheral lip (33) such that carbonated gases escaping through the notch (34) in the peripheral lip (33) of the bottle member (30) as the cap member (20) is initially disengaged from the bottle member (30) produces a whistling sound.

10 Claims, 2 Drawing Sheets

WHISTLING BEVERAGE BOTTLE CONSTRUCTION

BACKGROUND OF THE INVENTION

1. Field of the Invention

The present invention relates to the field of beverage bottle constructions in general, and in particular to a bottle construction that has sound generating feature built into the cooperating closure components.

2. Description of Related Art

As can be seen by reference to the following U.S. Pat. Nos. 4,583,651; 4,607,747; 4,756,222; 5,207,339; and 5,328,069, the prior art is replete with myriad and diverse beverage bottle constructions and associated closures.

While all of the aforementioned prior art constructions are more than adequate for the basic purpose and function for which they have been specifically designed, they are uniformly deficient with respect to their failure to provide a simple, efficient, and practical way to focus carbonation generated gases within the beverage container through a sound generating structure to produce an audible whistle or single tone note that accompanies the release of the carbonated gases.

As virtually everyone is aware, a hissing sound normally accompanies the opening of a carbonated beverage container; however, up until this time, the escaping carbonated gases have never been harnessed to produce a useful function.

As a consequence of the foregoing situation, there has existed a longstanding need for a new and improved type of carbonated beverage container closure that will generate a musical tone when the closure seal is broken in the act of removing the beverage cap, and the provision of such a construction is a stated objective of the present invention.

BRIEF SUMMARY OF THE INVENTION

Briefly stated, the whistling beverage bottle construction that forms the basis of the present invention comprises in general, a cap member having a sealing gasket member, and a beverage bottle member having a threaded neck portion provided with a notched mouth which cooperates with the sealing gasket member to define a discrete tone producing aperture that will focus all of the escaping carbonated gases through the tone generating aperture.

As will be explained in greater detail further on in the specification, in the first version of the preferred embodiment only the sealing gasket member and the notched bottle mouth are used to generate the musical tone.

In the second version of the preferred embodiment, a peripheral reed is interposed between the sealing gasket member and the notched bottle mouth to generate a warbling tone. In the third version of the preferred embodiment, an auxiliary whistle member is disposed proximate to the notched bottle mouth such that carbonated gases escaping through the notched bottle mouth will draw a portion of the remaining pressurized gases through the body of the whistle member.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
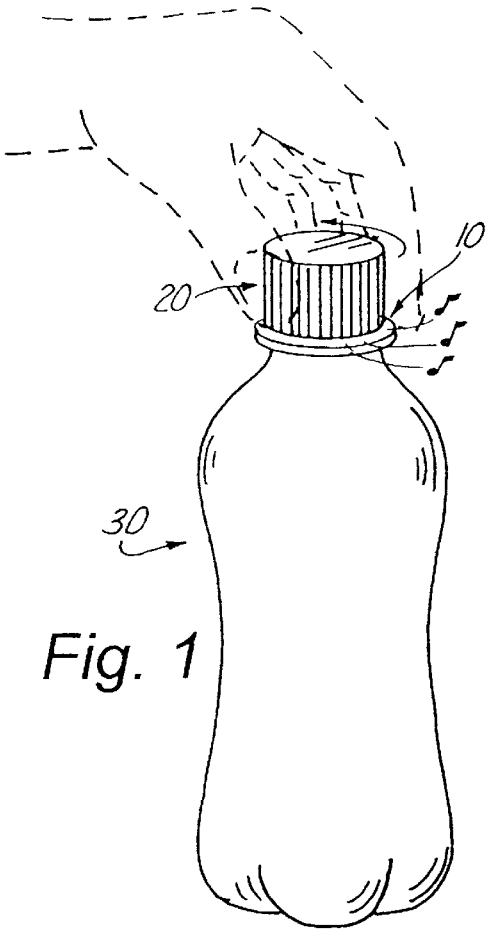
FIG. 1 is a perspective view of a carbonated beverage container built in accordance with the teachings of this invention.

As can be seen by reference to the drawings, and in particular to FIG. 1, the whistling beverage cap construction that forms the basis of the present invention is designated generally by the reference number 10. The main structural components of the construction 10 involve a cap member 20, and a bottle member 30. These units will now be described in seriatim fashion.

Figure 2:
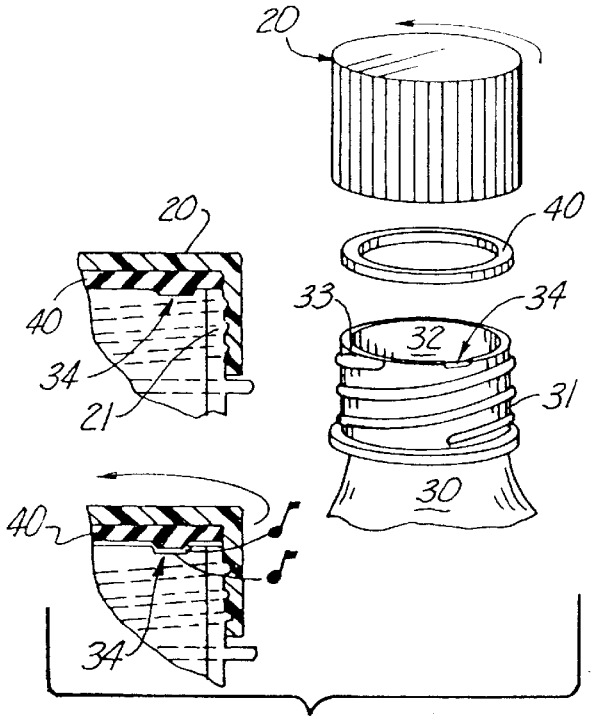
FIG. 2 is a combined exploded perspective view of the first version of this invention and internal detail views of the cap member in the closed and partially open position.
Figure 3:
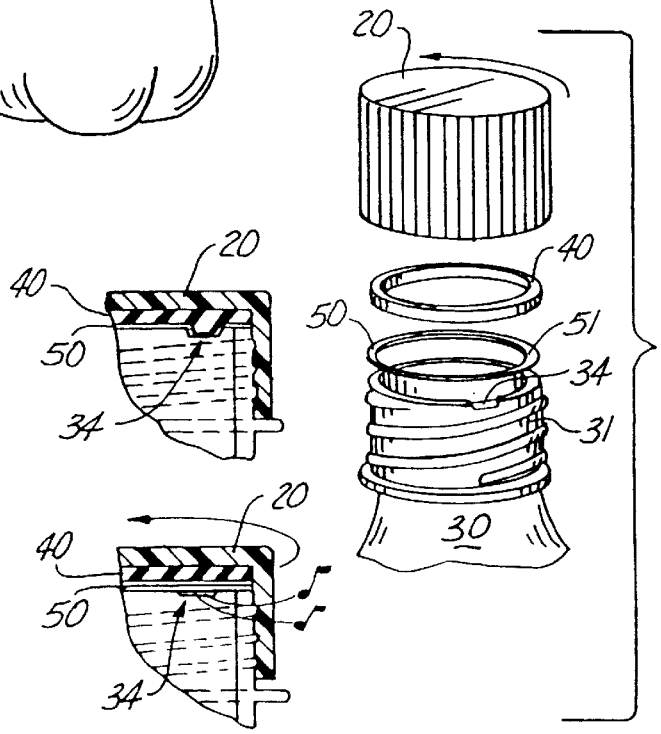
FIG. 3 is a combined exploded perspective view of the second version of this invention and internal detail views of the cap member in the closed and partially open position.

As shown in FIGS. 1 through 3 in all three version of this invention, the cap member 20 comprises a generally conventional cap member 20 having internal threads 21 and provided with a resilient sealing gasket member 40, and the bottle member 30 comprises a generally conventional bottle member 30 having an externally threaded neck portion 31 which terminates in a bottle mouth opening 32.

As can be seen by reference to FIGS. 2 through 5, the only noticeable difference between a conventional cap member 20 and a conventional bottle member 30 is the fact that the lip 33 of the bottle member 30 is provided with a discrete notch 34 whose purpose and function will be described in greater detail further on in the specification.

The first version of the preferred embodiment is depicted in FIG. 2. The resilient sealing gasket member 40 is adapted to be resiliently deformed to extend into the notch 34 in the peripheral lip 33 of the bottle member to form an air tight seal around the mouth 32 of the bottle member 30 when the cap member 20 is completely threadedly engaged with the neck 31 of the bottle member 30 as shown in the upper left hand portion of FIG. 2.

However, once the cap member 20 is partially unscrewed from the bottle member 30, that portion of the sealing gasket member 40 that is disposed within the notch 34 will become separated from engagement with the notch surface to allow the carbonated gases to escape through the notch 34 to produce a musical tone as depicted in the lower left hand portion of FIG. 2.

It should further be appreciated at this juncture that since the sealing gasket member 40 has a uniform thickness, the sealing engagement between the gasket member 40 and the notch 34 will be the weakest around the entire periphery of the gasket member 40, since that portion of the gasket member 40 experiences the least sealing compression between the cap member 20 and the bottle member 30.

Therefore, as the compression forces are uniformly relieved around the periphery of the sealing gasket 40, as the cap member 20 is begun to be unthreaded from the neck 31 of the bottle member 30, the sealing compression will break at the notch 34 to allow all of the compressed gases within the bottle member to escape through the notch and produce an audible tone or whistle.

Figure 4:
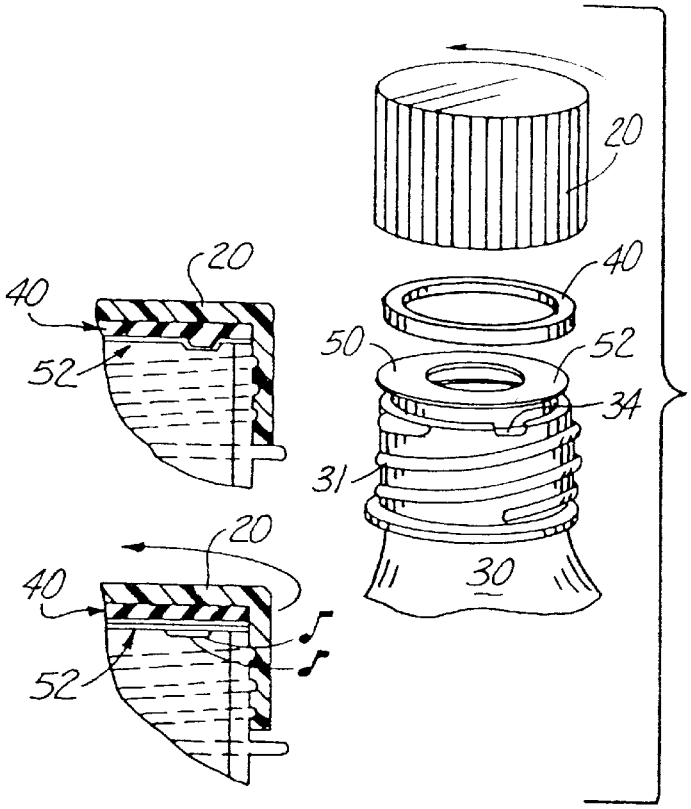
FIG. 4 is a combined exploded perspective view of a modified form of the second version of this invention and internal detail views of the cap member in the closed and partially open position.

Turning now to FIGS. 3 and 4, it can be seen that in the second version of the preferred embodiment, the sealing gasket member 40 is augmented with a peripheral reed member 50 which is interposed between the bottom of the sealing gasket member 40 and the top of the peripheral lip 33 of the bottle member 30.

As anyone who is familiar with wind instruments is well aware, a vibrating reed member 50 will produce a warbling tone as the air passes on opposite sides of the vibrating reed member 50.

In one form of the second version of the preferred embodiment illustrated in FIG. 3, the reed member 50 comprises a relatively slender thin ring 51 of flexible material such as plastic or the like. In the other form of the second version of the preferred embodiment illustrated in FIG. 4, the reed member 50 comprises a relatively wide thin ring 52 of flexible resilient material such as rubber or the like wherein the reed member 50 resembles a vibrating diaphragm or the like.

Figure 5:
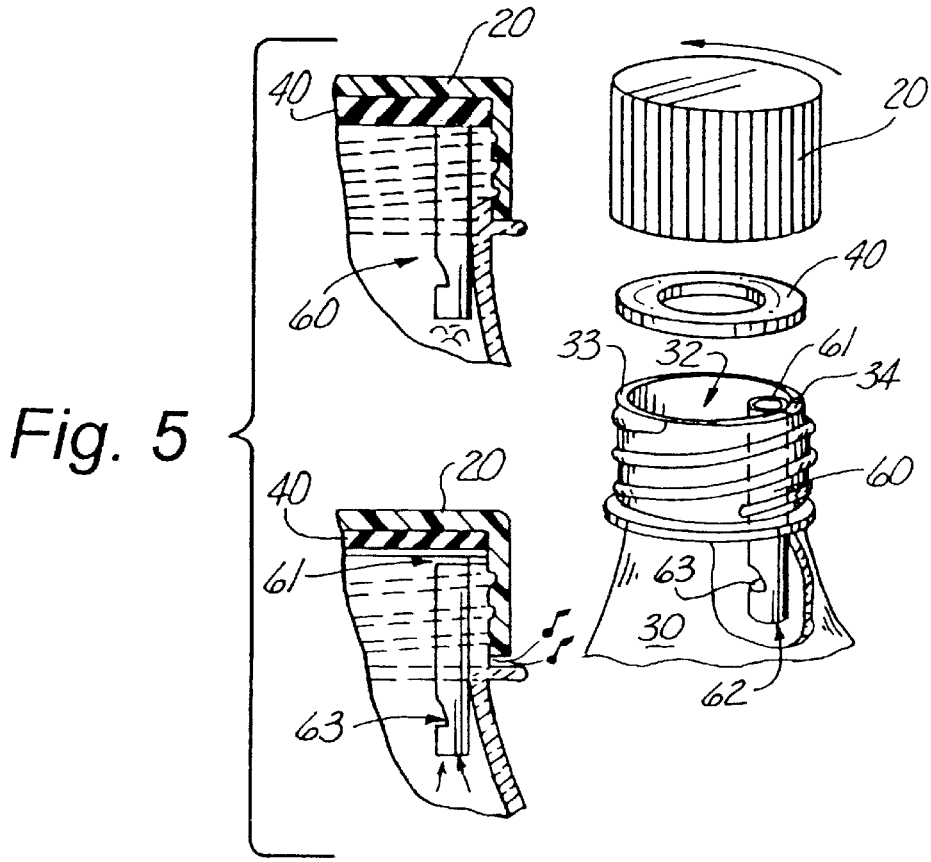
FIG. 5 is a combined exploded perspective view of the third version of this invention and internal detail views of the cap member in the closed and partially open position.

Turning now to FIG. 5, it can be seen that in the third version of the preferred embodiment, the interior of the neck 31 of the bottle member 30 is provided with a slender tubular whistle member 60 having an upper outlet end 61, a lower inlet end 62 and an intermediate whistle notch 63. The outlet end 61 is disposed adjacent to the notch 34 in the lip 33 of the bottle member 30.

Due to the positioning of the outlet end 61 of the whistle member 60 adjacent the notch 34 in the lip 33 of the bottle member 30, once the cap member 20 is initially unthreaded from the bottle member 30, the escaping carbonated gases will flow over the upper end 61 of the whistle member 60 drawing gases upwardly through the whistle member 60 in a well recognized manner to produce a musical tone.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

Having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

I claim:

1. A whistling beverage bottle construction comprising:

a beverage bottle member having an externally threaded neck portion which defines a mouth opening having a peripheral lip wherein the lip is provided with a notch;

a cap member having an internal threaded portion adapted to engage the external threaded neck portion of the bottle member; and a sealing gasket member dimensioned to be received within the cap member to form a sealing engagement between the cap member and the lip portion of the bottle member; wherein the compressive engagement of the sealing gasket member between the cap member and the bottle member is the least in the vicinity of the notch in the peripheral lip; and a peripheral reed member that is disposed intermediate the sealing gasket member and the peripheral lip of the bottle member.

2. The construction as in claim 1 wherein the peripheral reed member comprises a relatively slender thin ring of flexible material.

3. The construction as in claim 2 wherein said flexible material is plastic.

4. The construction as in claim 1 wherein the peripheral reed member comprises a relatively wide thin ring of flexible material.

5. The construction as in claim 4 wherein the flexible material is rubber.

6. A whistling bottle construction comprising:

a beverage bottle member having an externally threaded neck portion which defines a mouth opening provided with a peripheral lip;

a cap member having an internal threaded portion adapted to engage the external threaded neck portion of the bottle member;

a sealing gasket member dimensioned to be received within the cap member to form a sealing engagement between the cap member and the lip portion of the bottle member; and sound generating means associated with at least one of the sealing gasket members and the threaded neck portion of the bottle member as the cap member is threadedly disengaged from the bottle member; wherein the sound generating means comprises in least in part: a whistle member having an outlet end, and inlet end, and a whistle notch disposed proximate the inlet end wherein the outlet end of the whistle member is disposed proximate the peripheral lip of the bottle member.

7. The construction as in claim 6; wherein the sound generating means further comprises in part: a notch formed in the peripheral lip of the threaded neck portion of the bottle member.

8. A whistling bottle construction comprising:

a beverage bottle member having an externally threaded neck portion which defines a mouth opening provided with a peripheral lip;

a cap member having an internal threaded portion adapted to engage the external threaded neck portion of the bottle member;

a sealing gasket member dimensioned to be received within the cap member to form a sealing engagement between the cap member and the lip portion of the bottle member; and sound generating means associated with at least one of the sealing gasket members and the threaded neck portion of the bottle member as the cap member is threadedly disengaged from the bottle member wherein the sound generating means comprises in least in part: a whistle member having an outlet end, and inlet end, and a whistle notch disposed proximate the inlet end wherein the outlet end of the whistle member is disposed proximate the peripheral lip of the bottle member.

9. The construction as in claim 8 wherein the sound generating means further comprises in part: a notch formed in the peripheral lip of the threaded neck portion of the bottle member.

10. A whistling beverage bottle construction comprising:

a beverage bottle member having an externally threaded neck portion which defines a mouth opening having a peripheral lip therein the lip is provided with a notch;

a cap member having an internal threaded portion adapted to engage the external threaded neck portion of the bottle member; and a sealing gasket member dimensioned to be received within the cap member to form a sealing engagement between the cap member and the lip portion of the bottle member; wherein the compressive engagement of the sealing gasket member between the cap member and the bottle member is the least in the vicinity of the notch in the peripheral lip; and a whistle member having an inlet end, an outlet end, and a whistle notch disposed proximate the inlet end; wherein the outlet end i disposed proximate the notch in the peripheral lip of the bottle member.

* * * * *